US009429327B2

(12) United States Patent
Kim

(10) Patent No.: US 9,429,327 B2
(45) Date of Patent: Aug. 30, 2016

(54) HOSE BURNER

(71) Applicant: KOVEA CO., LTD., Bucheon-si (KR)

(72) Inventor: Sang Hyun Kim, Goyang-si (KR)

(73) Assignee: KOVEA CO., LTD. (KR)

( * ) Notice: Subject to any disclaimer, the term of this patent is extended or adjusted under 35 U.S.C. 154(b) by 309 days.

(21) Appl. No.: 14/221,586

(22) Filed: Mar. 21, 2014

(65) Prior Publication Data

US 2014/0290639 A1 Oct. 2, 2014

(30) Foreign Application Priority Data

Mar. 26, 2013 (KR) ..... 10-2013-0031834

(51) Int. Cl.
*F24C 3/14* (2006.01)
*F23D 14/28* (2006.01)

(52) U.S. Cl.
CPC ..... *F24C 3/14* (2013.01); *F23D 14/28* (2013.01)

(58) Field of Classification Search
CPC ..... F23D 14/28; F24C 3/14
See application file for complete search history.

(56) References Cited

U.S. PATENT DOCUMENTS 1,047,028 A * 12/1912 Foster ..... F24C 3/14 126/40
1,286,274 A * 12/1918 Gates ..... F24C 3/14 126/304 A
1,447,295 A 3/1923 Crisenberry
3,400,705 A * 9/1968 Axelsson ..... F23D 14/28 126/44
5,957,683 A * 9/1999 Yokoyama ..... F23D 14/06 126/39 R
6,182,651 B1 2/2001 Tornsten
2007/0006868 A1 1/2007 Svedlund

FOREIGN PATENT DOCUMENTS

| | | |
|---|---|---|
| CN | 2135112 | 6/1993 |
| CN | 2494938 | 6/2002 |
| CN | 202188532 | 4/2012 |
| JP | 1978052442 | 5/1978 |
| JP | 1996338610 | 12/1996 |
| TW | 258315 | 9/1995 |

* cited by examiner

*Primary Examiner* — Kenneth Rinehart
*Assistant Examiner* — Logan Jones
(74) *Attorney, Agent, or Firm* — Cantor Colburn LLP

(57) ABSTRACT

Disclosed is a hose burner capable of being carried by a user in a convenient manner. The hose burner comprises: a body unit including a cylindrical body having an open upper surface and having an insertion opening penetratingly-formed at one side thereof, and including an air mixture container accommodated in the body, and configured to mix injected fuel and air to combust the fuel; a fuel supply pipe having a fuel supply opening at one end thereof, bent to pass through an upper surface of the body unit, and having a fuel injection nozzle at another end thereof, the fuel supply opening inserted into the insertion opening of the body and protruding toward the air mixture container; and a supporting unit configured to support the body unit installed with a predetermined gap from an installation surface.

4 Claims, 5 Drawing Sheets

HOSE BURNER

BACKGROUND OF THE DISCLOSURE

1. Field of the Disclosure

The present disclosure relates to a burner, and particularly, to a hose burner capable of enhancing a user's portability.

2. Background of the Disclosure

The conventional portable burner, which has been used in the outdoor field for cooking, etc., may be classified into a gas burner and an oil burner. The oil burner has complicated setting procedures, and causes a novice to use it with a difficulty. As the oil burner should be preheated by alcohol, etc., a user's portability is lowered, a preheating process is inconvenient, etc. Further, if the oil burner is preheated at an improper time, soot is generated to block a nozzle. This may cause a user to clean the nozzle after cooling the oil burner, and then to preheat the oil burner again.

Further, as flame is controlled by an air valve, it is difficult to properly control the flame. If there remains a pressure inside an oil container, oil is emitted to outside. Accordingly, upon completion of usage of the oil bur, air should be discharged. Further, the oil burner should be compressed whenever it is used.

On the other hand, the gas burner may have the following disadvantages despite its simple usage.

Firstly, the gas burner is expensive, and uses butane gas having small calories, etc. Accordingly, a user should prepare a container filled with a large amount of gas during a long travel. Secondly, a one-time container should be abandoned after it is used one time. This may lower an economic characteristic, and may cause a user not to carry the gas burner during a long travel.

In order to solve such problems, a burner, which can be used simply and enhance a user's portability by having a minimized size after usage, is required in recent years.

SUMMARY OF THE DISCLOSURE

Therefore, an aspect of the detailed description is to provide a hose burner capable of being used through a user's simple manipulation, and capable of enhancing a user's portability by having a minimized size with a transformed shape after usage.

To achieve these and other advantages and in accordance with the purpose of this specification, as embodied and broadly described herein, there is provided a hose burner, comprising: a body unit including a cylindrical body having an open upper surface and having an insertion opening penetratingly-formed at one side thereof, and including an air mixture container accommodated in the body, and configured to mix injected fuel and air to combust the fuel; a fuel supply pipe having a fuel supply opening at one end thereof, bent to pass through an upper surface of the body unit, and having a fuel injection nozzle at another end thereof, the fuel supply opening inserted into the insertion opening of the body and protruding toward the air mixture container; and a supporting unit configured to support the body unit installed with a predetermined gap from an installation surface, wherein the air mixture container includes an outer container accommodated in the body, and having an air supply cut-out surface communicated with the fuel supply opening; an inner container provided in the outer container, and forming a fuel discharge portion for discharging the fuel to a gap between the inner container and the outer container; and a mixture pipe configured to connect the air supply cut-out surface and the fuel discharge portion with each other.

The mixture pipe may be formed to pass through at least an inner part of the inner container.

The mixture pipe may be formed to cross the inner container.

The mixture pipe may be configured such that its bottom surface is downward inclined toward the fuel supply opening when the air mixture container is accommodated in the body.

A burner cap, which has a plurality of slits penetratingly-formed in a circumferential direction such that flame generated when the fuel is combusted is uniformly arranged along a circumference of the air mixture container, may be mounted to an upper surface of the air mixture container.

A shielding cover, configured to shield part of an upper surface of the fuel discharge portion from outside for prevention of excessive mixture between the fuel and the air, may be provided on the upper surface of the fuel discharge portion between the air mixture container and the burner cap.

The shielding cover may include a ring-shaped member having a predetermined area and configured to shield part of the upper surface of the fuel discharge portion in a horizontal direction; and a protruding member protruding from an inner surface of the ring-shaped member by a predetermined length in a height direction, and disposed to be spaced from a circumferential surface of the inner container.

The hose burner according to the present invention can have the following advantages.

Firstly, the hose burner can be simply used without an additional manipulation such as suction air control or preheating. This can allow even a novice to easily use the hose burner, and thus can enhance a user's satisfaction degree.

Secondly, the hose burner can have a minimized size by having a transformed shape after usage. This can allow a user to carry the hose burner in a simple manner, and thus a user's portability can be enhanced.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a hose burner according to an embodiment of the present invention will be explained in more detail with reference to the attached drawings.

Figure 1:
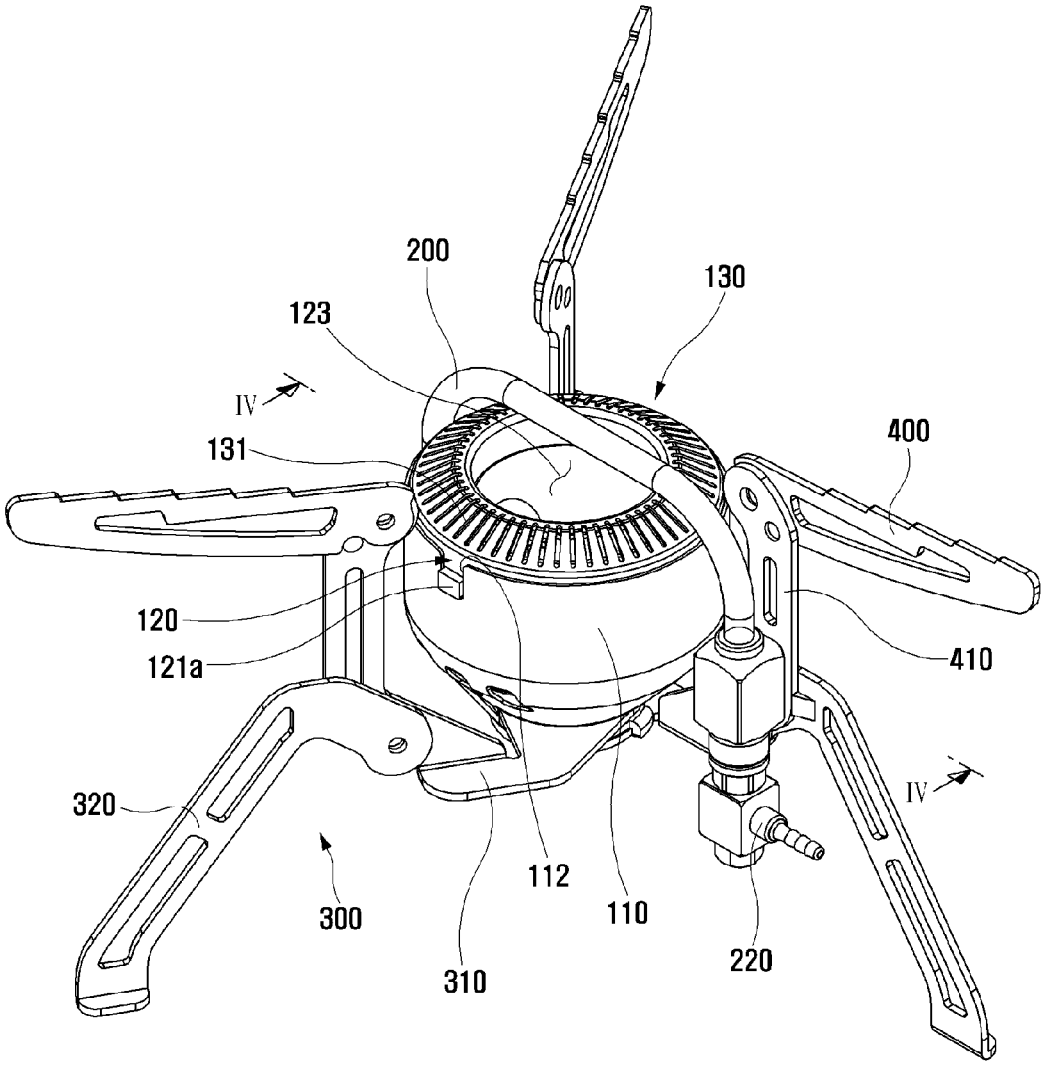
FIG. 1 is a perspective view illustrating a structure of a hose burner according to an embodiment of the present invention.
Figure 2:
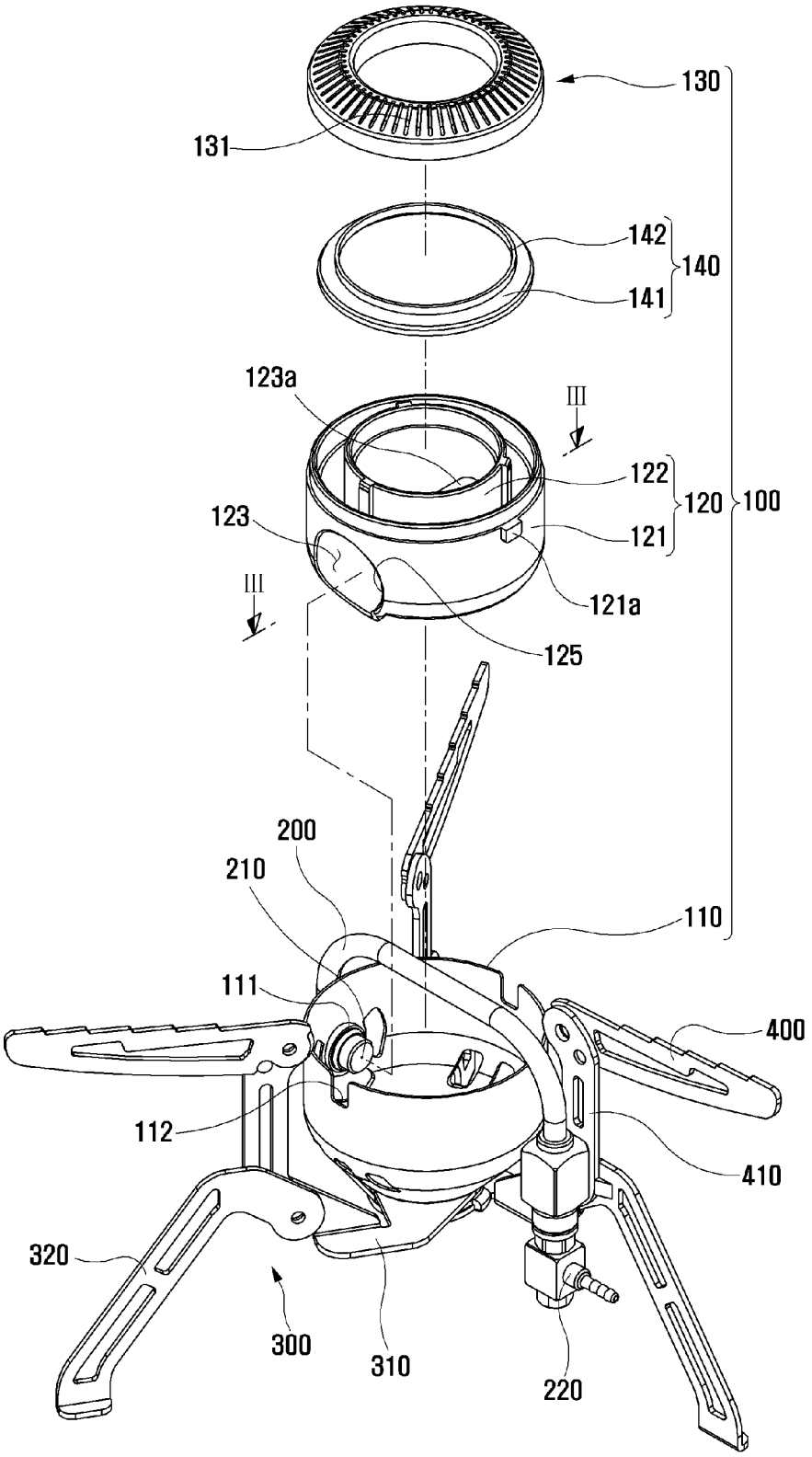
FIG. 2 is a disassembled perspective view illustrating a structure of a hose burner according to an embodiment of the present invention.
Figure 3:
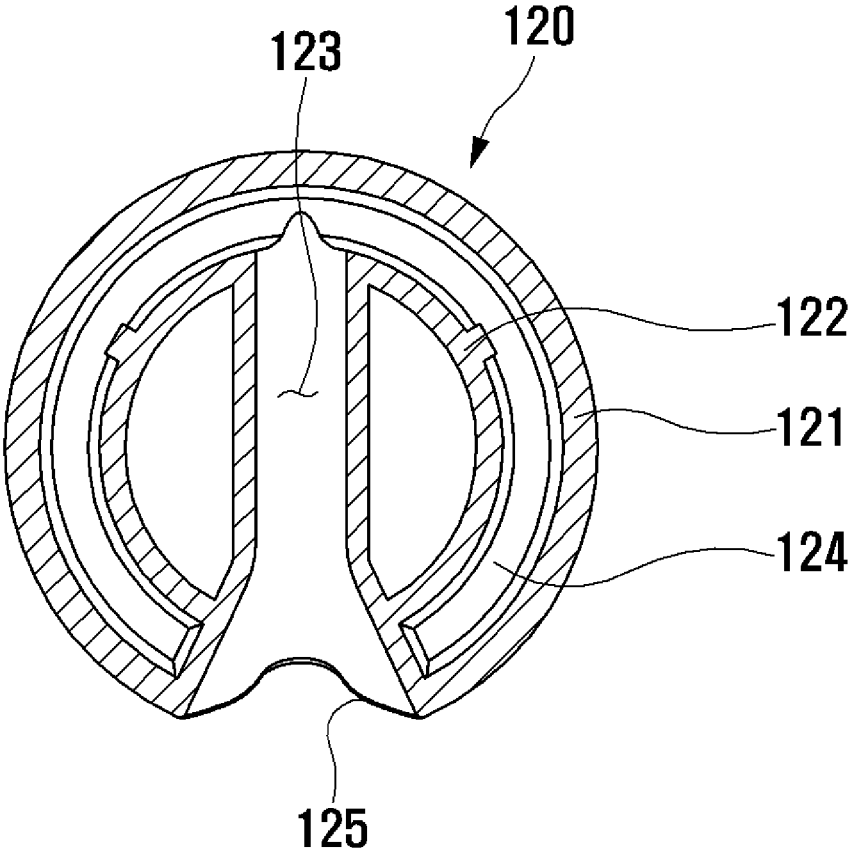
FIG. 3 is a sectional view taken along line 'III-III' in FIG. 2.
Figure 4:
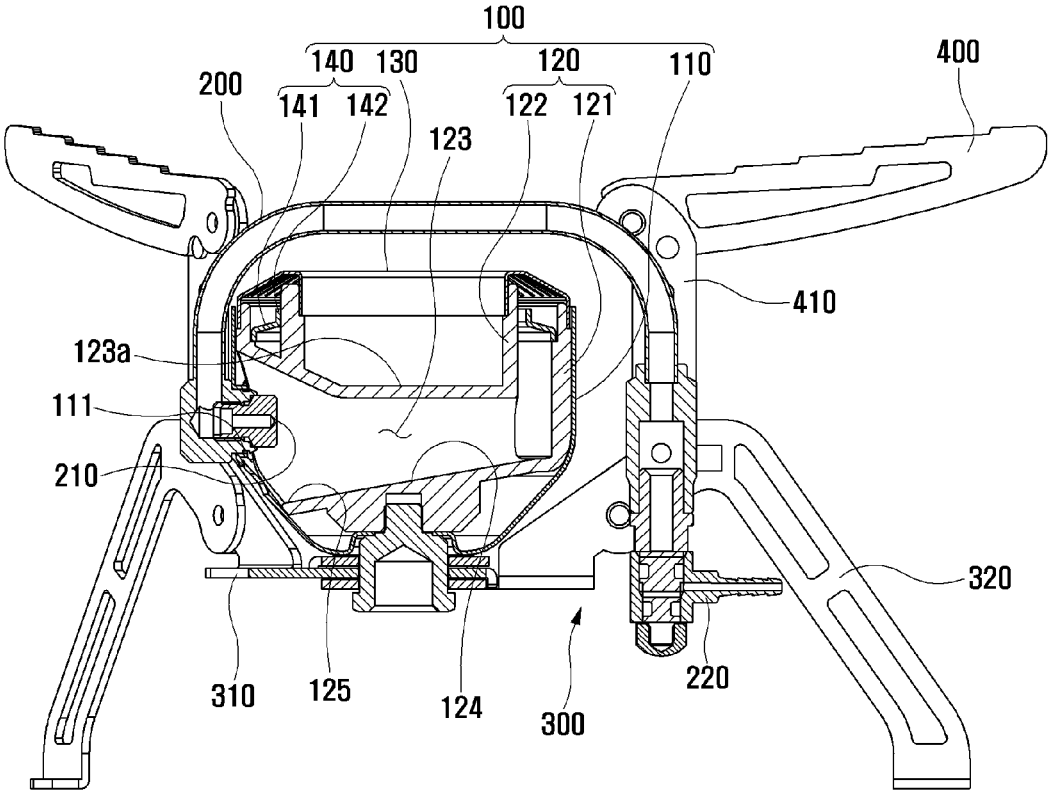
FIG. 4 is a sectional view taken along line 'IV-IV' of FIG. 1.
Figure 5:
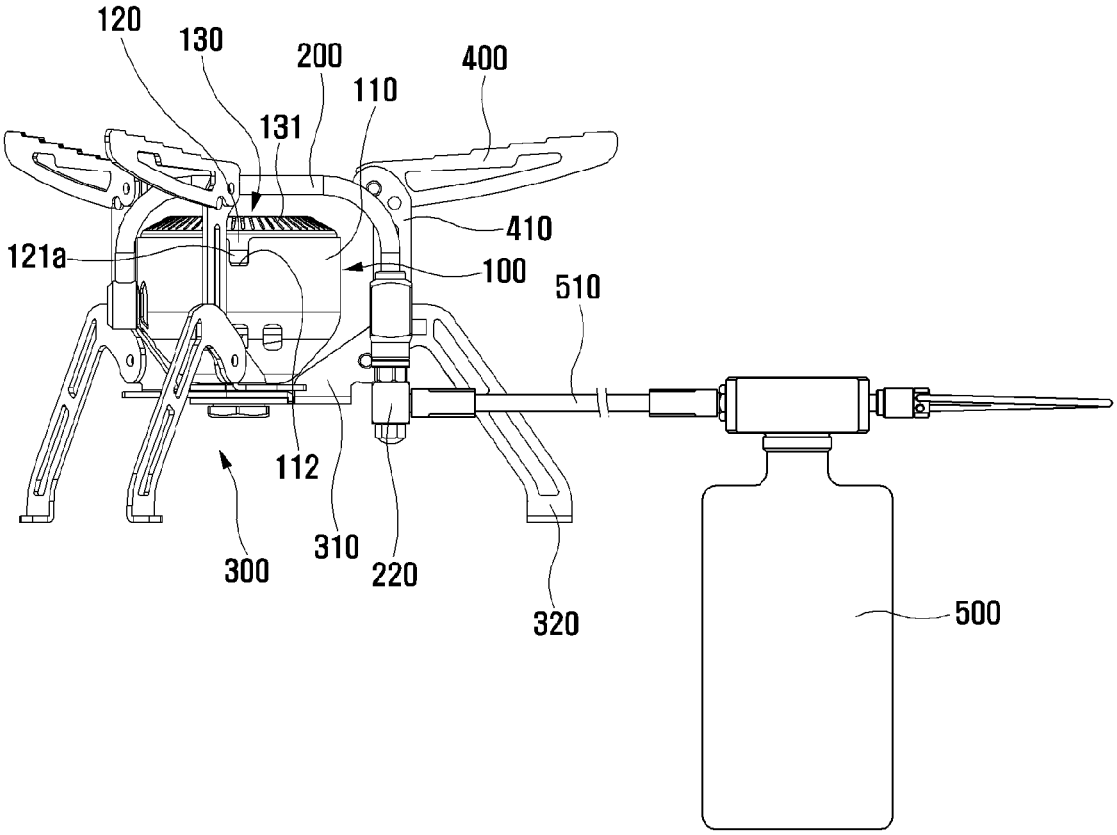
FIG. 5 is a side sectional view illustrating a connection structure between a hose burner according to an embodiment of the present invention and a fuel container.

FIG. 1 is a perspective view illustrating a structure of a hose burner according to an embodiment of the present invention, FIG. 2 is a disassembled perspective view illustrating a structure of a hose burner according to an embodiment of the present invention, FIG. 3 is a sectional view taken along line 'III-III' in FIG. 2, FIG. 4 is a sectional view taken along line 'IV-IV' of FIG. 1, and FIG. 5 is a side sectional view illustrating a connection structure between a hose burner according to an embodiment of the present invention and a fuel container.

As shown, the hose burner according to an embodiment of the present invention comprises: a body unit 100 including a cylindrical body 110 having an open upper surface and having an insertion opening 111 penetratingly-formed at one side thereof, and including an air mixture container 120 accommodated in the body 110, and configured to mix injected fuel and air to combust the fuel; a fuel supply pipe 200 having a fuel supply opening 210 at one end thereof, bent to pass through an upper surface of the body unit 100, and having a fuel injection nozzle 220 at another end thereof, the fuel supply opening 210 inserted into the insertion opening 111 of the body 110 and protruding toward the air mixture container 120; and a supporting unit 300 configured to support the body unit 100 installed with a predetermined gap from an installation surface, wherein the air mixture container 120 includes an outer container 121 accommodated in the body 110, and having an air supply cut-out surface 125 communicated with the fuel supply opening 210; an inner container 122 provided in the outer container 121, and forming a fuel discharge portion 124 for discharging the fuel to a gap between the inner container 122 and the outer container 121; and a mixture pipe 123 configured to connect the air supply cut-out surface 125 and the fuel discharge portion 124 with each other.

Preferably, the body unit 100, a member for providing heat to an object by igniting flame when using the hose burner, is configured to provide a user's desired amount of heat to an object by supplied fuel.

As aforementioned, the body unit 100 is composed of a body 110 which forms the appearance of the body unit 100, and an air mixture container 120 accommodated in the body 110.

The body 110 is provided with the insertion opening 111 penetratingly-formed at one side thereof, the insertion opening 111 configured to insert the fuel supply opening 210 thereinto to thus protrude the fuel supply opening 210 toward inside of the body 110. The body 110 has an open upper surface, and has a predetermined inner space for accommodating the air mixture container 120.

A bottom surface of the body 110 is formed to protrude in a wedge shape, and a body supporting member 310 of the supporting unit 300 to be explained later is rotatably coupled to a circumference of the bottom surface outward-s protruded in a convexed manner.

Mounting grooves 112 configured to mount the air mixture container 120 when the air mixture container 120 is accommodated in the body 110, are concaved from upper regions of a plate surface in a facing manner.

The air mixture container 120 accommodated in the body 110 is a member configured to mix supplied fuel with external air so that the fuel can be completely combusted for prevention of exhaust gas. The air mixture container 120 has the same cylindrical shape as the body 110.

The air mixture container 120 is provided with a mixture pipe 123 through which external air is introduced to be supplied when fuel is combusted. The mixture pipe 123 allows external air to be mixed with fuel for complete combustion of the fuel, thereby preventing occurrence of exhaust gas.

The combustion pipe 123 may be formed to pass through at least part of inside of the inner container 122. Alternatively, the combustion pipe 123 may be formed from one side of the outer container 121 where the air supply cut-out surface 125 has been formed, to an opposite side to the outer container 123, by completely crossing the inner container 122.

The air mixture container 120 may include a ring-shaped outer container 121 having a predetermined diameter and a predetermined height, and formed to contact an inner surface of the body 110; an inner container 122 having a smaller diameter than the outer container 121, spaced from the outer container 121, and forming a space where the fuel is discharged; and a fuel discharge portion 124 formed between the outer container 121 and the inner container 122, and configured to discharge fuel.

The outer container 121 is a ring-shaped member having an open upper surface and formed to have a predetermined height. The outer container 121 has a diameter large enough to contact an inner wall surface of the body 110, thereby being accommodated in the body 110.

Mounting protrusions 121*a*, which are inserted into the mounting grooves 112, are protruding from upper regions of the outer container 121 facing each other with a constant interval therebetween, so that the outer container 121 can be mounted at the mounting grooves 112 of the body 110 when the outer container 121 is accommodated in the body 110.

The inner container 122 is formed to have a smaller diameter than the outer container 121, and is provided in the outer container 121 with a spacing distance from the outer container 121. Due to the spacing distance between the outer container 121 and the inner container 122, flame is combusted by the fuel discharge portion 124 formed by the spacing distance.

The air supply cut-out surface 125, configured to supply external air into the air mixture container 120, may be formed at a plate surface of each of the outer container 121 and the inner container 122 where the fuel supply opening 210 is disposed when the air mixture container 120 is accommodated in the body 110.

More specifically, the air supply cut-out surface 125 is provided at a plate surface of each of the outer container 121 and the inner container 122 facing each other.

An outer surface 123*a* is formed to enclose a circumference of the air supply cut-out surface 125 formed at the outer container 121, and to enclose a circumference of the air supply cut-out surface 125 formed at the inner container 122. Under such configuration, the mixture pipe 123 is formed.

Preferably, a bottom surface of the mixture pipe 123 is formed to be inclined toward the fuel supply opening 210. The reason is in order to prevent fuel supplied from the fuel supply portion 210, from being provided to the fuel discharge portion 124 temporarily and excessively.

A burner cap 130, which has a plurality of slits 131 penetratingly-formed in a circumferential direction of the air mixture container 120 such that flame generated when the fuel is combusted is uniformly arranged along a circumference of the air mixture container 120, may be mounted to an upper surface of the air mixture container 120.

The burner cap 130 is installed at an upper surface of a space between the outer container 121 and the inner container 122, thereby guiding flame generated by fuel supplied toward the fuel discharge portion 124 to be uniformly ignited along the upper surface of the space.

A shielding cover 140, configured to shield part of an upper surface of the mixture pipe 123 from outside for prevention of excessive mixture between the fuel and air, may be provided at an upper surface of the air mixture container 120 between the air mixture container 120 and the burner cap 130.

The shielding cover 140 may include a ring-shaped member 141 having a predetermined area and configured to shield part of an upper surface of the fuel discharge portion 124 in a horizontal direction; and a protruding member 142 protruding from an inner surface of the ring-shaped member 141 by a predetermined length in a height direction, and disposed to be spaced from a circumferential surface of the inner container 122.

Under such configuration, external air is introduced into the mixture pipe 123 through the gap between the inner container 122 and the protruding member 142, and is mixed with fuel. Accordingly, excessive mixture between air and fuel can be prevented by the shielding cover 140.

The fuel supply pipe 200 is connected to a fuel container 500 by an extended pipe 510, and is configured to supply fuel to the mixture pipe 123. For this, the fuel supply opening 210 to be inserted into the insertion opening 111 of the body 110 is provided at one end of the fuel supply pipe 200. The fuel injection nozzle 220, connected to the extended pipe 510 and configured to inject fuel from the fuel container 500 to the fuel supply pipe 200, is formed at another end of the fuel supply pipe 200.

Preferably, the fuel supply pipe 200 is bent so as to pass through an upper surface of the body unit 100, so that the hose burner can be automatically preheated without an additional manipulation for preheating.

The supporting portion 300 includes a plurality of body supporting members 310 extending from a bottom surface of the body unit 100 by a predetermined length in a diameter direction of the body unit 100; and a plurality of supporting legs 320 provided at an end of the body supporting members 310, mounted to an installation surface, and configured to support the body unit 100.

Preferably, the body supporting members 310 are rotatably provided at a bottom surface of the body unit 100, so that the hose burner can be easily stored with a decreased volume (minimized size) as the plurality of supporting legs 320 are assembled together to one side.

Preferably, the supporting legs 320 are rotatably coupled to one side of the body supporting members 310, so that the hose burner can have a decreased volume when stored.

The supporting legs 320 are bent to have a 'ㄱ' shape, so as to enclose an outer surface of the body unit 100 of the hose burner, when the hose burner is stored.

Extended members 410, which are upward extending by a predetermined length in a height direction of the body unit 100, are fixedly-coupled to one side of the body supporting members 310. Heating object supporting plates 400, configured to heat an object using the hose burner by mounting the object above the body unit 100, are additionally provided at the end of the extended members 410.

Preferably, the heating object supporting plates 400 are configured as three members radially widened by 120° so that a heating object mounted thereon can be stably supported.

Like the supporting legs 320, the heating object supporting plates 400 are preferably rotatably coupled to the end of the extended members 410 so that the hose burner can have a decreased entire size when stored without being used.

A method for using the hose burner according to an embodiment of the present invention will be explained as follows.

Firstly, the plurality of body supporting members 310 are rotated so as to be radially disposed by being widened at 120°, thereby making the supporting legs 320 spaced from each other.

Then, the heating object supporting plates 400, which are rotatably coupled to the end of the extended members 410, are widened by being outward rotated from the center of the hose burner, so that an object to be heated can be stably mounted to the heating object supporting plates 400.

Then, the end of the extended pipe 510, to which the fuel container 500 has been connected, is fitted into the fuel injection nozzle 220 for communication. As a result, fuel inside the fuel container 500 is supplied through the fuel supply opening 210, and the supplied fuel is mixed with air at the mixture pipe 123 of the air mixture container 120.

In case of initial ignition using a match, a lighter, etc., the fuel mixed with air is combusted, and the fuel which passes through inside of the fuel supply opening 210 which passes through an upper surface of the body unit 100 is vaporized. As the vaporized fuel is continuously supplied through the fuel supply opening 210, heat is supplied to an object to be heated for cooking.

After the hose burner is used up, the body supporting members 310 of the supporting unit 300 are rotated so that the plurality of supporting legs 320 can be assembled one another. Then, the supporting legs 320 and the heating object supporting plates 400 are folded to enclose an outer surface of the body unit 100, so that the hose burner can be stored with a minimized size.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A hose burner, comprising:

a body unit including a cylindrical body having an open upper surface and having an insertion opening penetratingly-formed at one side thereof, and including an air mixture container accommodated in the body and configured to mix injected fuel and air to combust the fuel;

a fuel supply pipe having a fuel supply opening at one end thereof, bent to pass through an upper surface of the body unit, and having a fuel injection nozzle at another end thereof, the fuel supply opening inserted into the insertion opening of the body and protruding toward the air mixture container; and a supporting unit configured to support the body unit installed with a predetermined gap from an installation surface, wherein the air mixture container includes:

an outer container accommodated in the body, and having an air supply cut-out surface communicated with the fuel supply opening;

an inner container provided in the outer container, and forming a fuel discharge portion for discharging the fuel to a gap between the inner container and the outer container; and a mixture pipe configured to connect the air supply cut-out surface and the fuel discharge portion with each other, wherein a burner cap, which has a plurality of slits penetratingly-formed in a circumferential direction such that flame generated when the fuel is combusted is uniformly arranged along a circumference of the air mixture container, is mounted to an upper surface of the air mixture container, wherein a shielding cover, configured to shield part of an upper surface of the fuel discharge portion from outside for prevention of excessive mixture between the fuel and the air, is provided on the upper surface of the fuel discharge portion between the air mixture container and the burner cap, and wherein the shielding cover includes: a ring-shaped member having a predetermined area and configured to shield part of the upper surface of the fuel discharge portion in a horizontal direction; and a protruding member protruding from an inner surface of the ring-shaped member by a predetermined length in a height direction, and disposed to be spaced from a circumferential surface of the inner container.

2. The hose burner of claim 1, wherein the mixture pipe is formed to pass through at least an inner part of the inner container.

3. The hose burner of claim 2, wherein the mixture pipe is formed to cross the inner container.

4. The hose burner of claim 3, wherein the mixture pipe is configured such that its bottom surface is downward inclined toward the fuel supply opening when the air mixture container is accommodated in the body.

* * * * *